US008073572B2

(12) United States Patent
Schweitzer

(10) Patent No.: US 8,073,572 B2
(45) Date of Patent: Dec. 6, 2011

(54) APPARATUS, METHOD AND COMPUTER PROGRAM PRODUCT FOR MODIFYING A SURFACE OF A COMPONENT

(75) Inventor: Marc O. Schweitzer, San Jose, CA (US)

(73) Assignee: Tara Technologies, Inc., Daytona Beach, FL (US)

( * ) Notice: Subject to any disclaimer, the term of this patent is extended or adjusted under 35 U.S.C. 154(b) by 620 days.

(21) Appl. No.: 12/061,900

(22) Filed: Apr. 3, 2008

(65) Prior Publication Data

US 2008/0248719 A1 Oct. 9, 2008

Related U.S. Application Data

(60) Provisional application No. 60/909,863, filed on Apr. 3, 2007.

(51) Int. Cl.

| | |
|---|---|
| ***G05D 7/00*** | (2006.01) |
| ***G05D 11/00*** | (2006.01) |
| ***C21D 7/06*** | (2006.01) |
| ***B05C 11/00*** | (2006.01) |
| ***B05B 1/32*** | (2006.01) |
| ***B24B 1/00*** | (2006.01) |
| ***B24C 1/00*** | (2006.01) |
| ***B24C 7/00*** | (2006.01) |
| ***B24C 5/04*** | (2006.01) |

(52) U.S. Cl. ..... 700/283; 72/53; 118/683; 118/684; 239/452; 451/38; 451/101; 451/102

(58) Field of Classification Search ..... 700/282, 700/283; 451/64, 75, 101, 102, 38, 40; 427/2.1, 427/2.14, 2.24, 96.1; 239/390–397, 451–458; 118/679–681, 683–686; 72/39, 40, 53
See application file for complete search history.

(56) References Cited

U.S. PATENT DOCUMENTS

| | | | | | |
|---|---|---|---|---|---|
| 4,080,762 | A | * | 3/1978 | Watson | 451/102 |
| 4,273,289 | A | * | 6/1981 | Jette | 239/458 |
| 4,343,345 | A | * | 8/1982 | Brugger | 164/33 |
| 4,649,061 | A | * | 3/1987 | Rangachar | 427/78 |
| 5,235,733 | A | | 8/1993 | Willbanks et al. | 28/105 |
| 5,277,048 | A | * | 1/1994 | Lubas | 72/53 |
| 5,361,993 | A | | 11/1994 | Andersson | 239/752 |
| 5,700,181 | A | * | 12/1997 | Hashish et al. | 451/40 |
| 5,851,158 | A | * | 12/1998 | Winrow et al. | 473/330 |
| 6,105,882 | A | * | 8/2000 | Woltjen | 239/394 |
| 6,390,801 | B1 | * | 5/2002 | Smith | 425/458 |

(Continued)

FOREIGN PATENT DOCUMENTS

JP 04278221 A * 10/1992

OTHER PUBLICATIONS

International Preliminary Report of Patentability from PCT Application No. PCT/US08/04368 mailed on Sep. 1, 2009.

(Continued)

*Primary Examiner* — Crystal J Barnes-Bullock
(74) *Attorney, Agent, or Firm* — Holland & Hart LLP

(57) ABSTRACT

An apparatus, method and computer program product for modifying a surface of a component is provided. In use, a surface of a component is translated relative to at least one jet for a period of time to form a plurality of features thereon.

46 Claims, 4 Drawing Sheets

U.S. PATENT DOCUMENTS

| | | | | |
|---|---|---|---|---|
| 6,464,567 | B2 * | 10/2002 | Hashish et al. | 451/38 |
| 6,502,442 | B2 * | 1/2003 | Arola et al. | 72/53 |
| 6,602,430 | B1 * | 8/2003 | Nally et al. | 216/13 |
| 6,675,548 | B2 * | 1/2004 | Bristol et al. | 52/745.01 |
| 6,812,471 | B2 * | 11/2004 | Popiolkowski et al. | 250/492.1 |
| 6,918,927 | B2 * | 7/2005 | Bates et al. | 623/1.15 |
| 7,351,290 | B2 * | 4/2008 | Rutkowski et al. | 118/683 |
| 7,360,437 | B2 * | 4/2008 | Hardwicke et al. | 73/763 |
| 7,563,503 | B2 * | 7/2009 | Gell et al. | 428/304.4 |
| 7,771,644 | B2 * | 8/2010 | Flather et al. | 264/307 |
| 2001/0046834 | A1 * | 11/2001 | Ramana et al. | 451/526 |
| 2003/0012978 | A1 | 1/2003 | Sodani et al. | 428/659 |
| 2003/0173526 | A1 | 9/2003 | Popiolkowski et al. | 250/492.1 |
| 2003/0188881 | A1 | 10/2003 | Stark | 174/52.4 |
| 2005/0140987 | A1 | 6/2005 | Xie | 356/512 |
| 2005/0206243 | A1 | 9/2005 | Bouche | 307/112 |
| 2006/0068109 | A1 * | 3/2006 | Frankenberger et al. | 427/256 |
| 2008/0008968 | A1 * | 1/2008 | Zombo | 430/311 |
| 2009/0080469 | A1 * | 3/2009 | Nikolajsen | 372/6 |
| 2009/0120462 | A1 * | 5/2009 | West et al. | 134/18 |

OTHER PUBLICATIONS

International Search Report and Written Opinion from PCT Application No. PCT/US08/04368 mailed on Jul. 9, 2008.

* cited by examiner

APPARATUS, METHOD AND COMPUTER PROGRAM PRODUCT FOR MODIFYING A SURFACE OF A COMPONENT

RELATED APPLICATION(S)

This application claims priority to a provisional application filed Apr. 3, 2007 under application Ser. No. 60/909,863, which is incorporated herein by reference in its entirety for all purposes.

FIELD OF THE INVENTION

The present invention relates to surfaces of components, and more particularly to modifying the surface and features of the components.

BACKGROUND

Many industries have a need for components that have a surface texture or surface form. For example, performance of semiconductor process chamber components, medical implant components, and aerospace components may be enhanced by applying a surface texture. Presently, there is not a cost effective method to generate a surface texture or morphology on components or parts which cannot be modified by methods such as grinding, machining, or other common manufacturing processes.

There is thus a need for addressing these and/or other issues associated with the prior art.

SUMMARY

An apparatus, method and computer program product for modifying a surface of a component is provided. In use, a surface of a component is translated relative to at least one jet for a period of time to form a plurality of features thereon.

DETAILED DESCRIPTION

Figure 1:
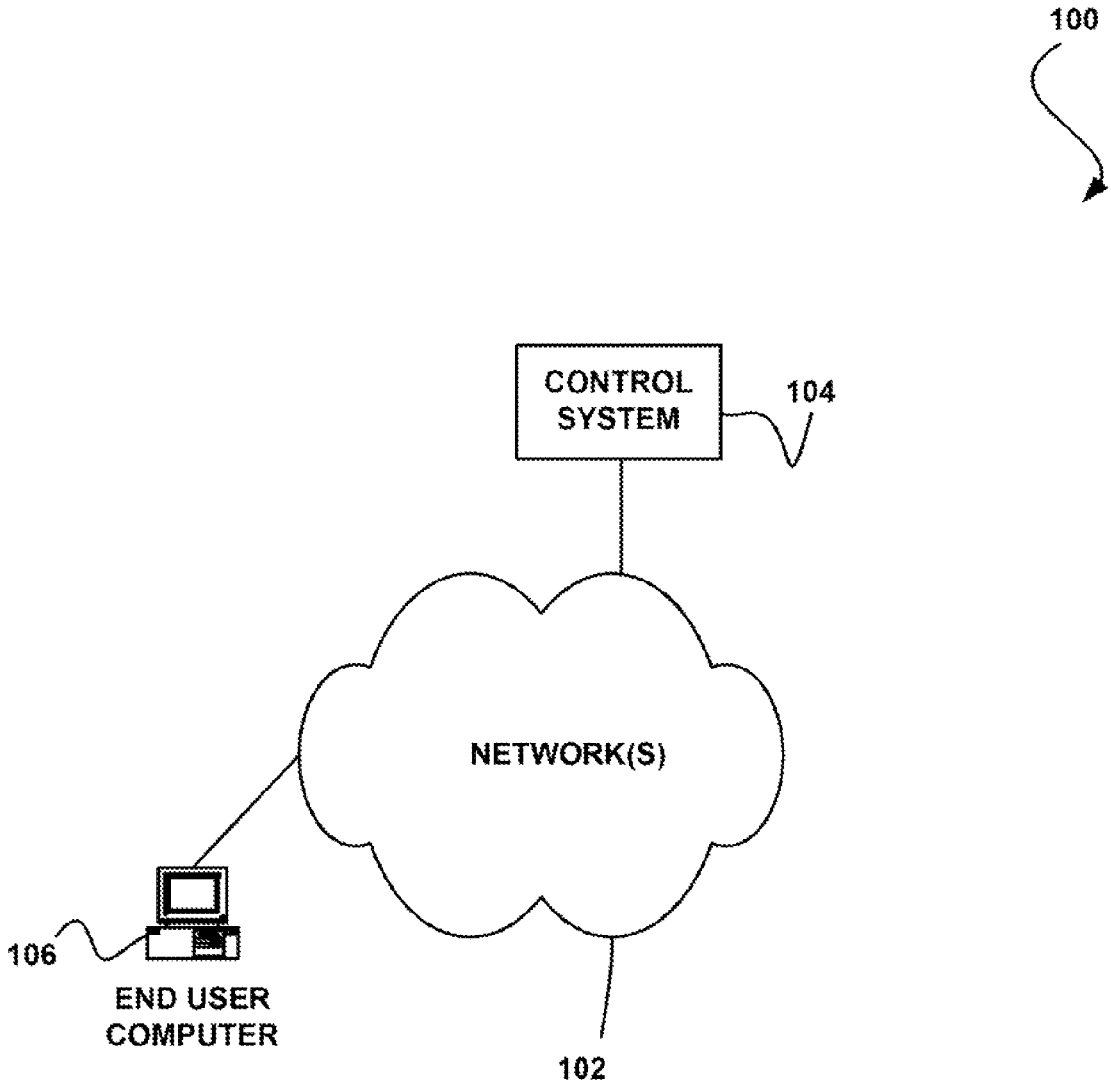
FIG. 1 illustrates a network architecture, in accordance with one possible embodiment.

FIG. 1 illustrates a network architecture 100, in accordance with one possible embodiment. As shown, at least one network 102 is provided. In the context of the present network architecture 100, the network 102 may take any form including, but not limited to a telecommunications network, a local area network (LAN), a wireless network, a wide area network (WAN) such as the Internet, peer-to-peer network, cable network, etc. While only one network is shown, it should be understood that two or more similar or different networks 102 may be provided.

Coupled to the network 102 may be a plurality of devices. For example, a particle entrained gas jet control system 104 (or any other jet, for that matter) and an end user computer 106 may be coupled to the network 102 for communication purposes. Such end user computer 106 may include a desktop computer, lap-top computer, programmable logic controller and/or any other type of logic. In addition, such control system 104 may be any control system that may be utilized to implement the method(s) set forth below. While a network 102 is shown in FIG. 1, it should be noted that other embodiments are contemplated where no such network is utilized and the end user computer 106 and the control system 104 are directly coupled or are integrated into a single system (e.g. a particle entrained gas jet system, etc.).

Figure 2:
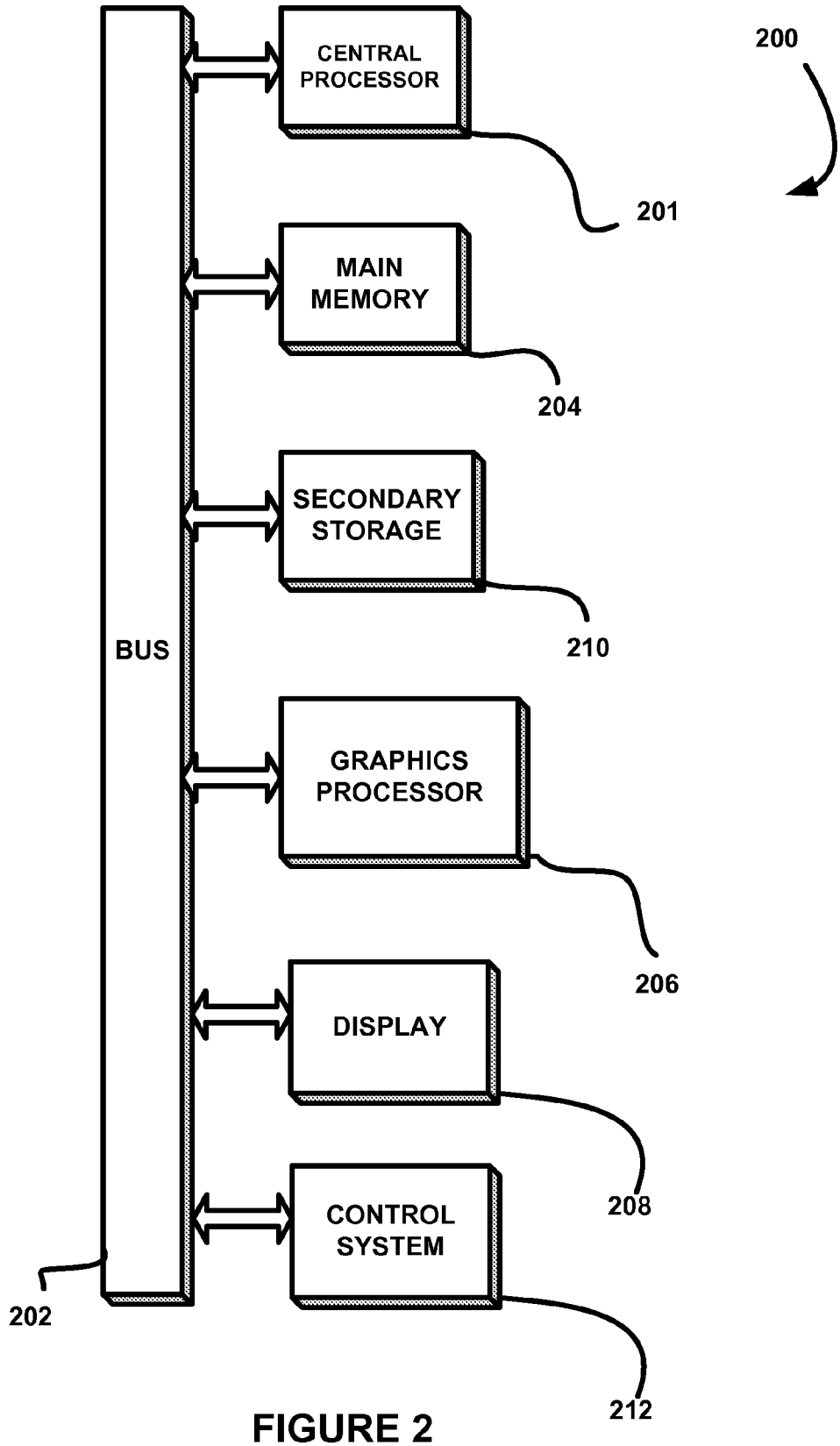
FIG. 2 illustrates an exemplary system, in accordance with one embodiment.

FIG. 2 illustrates an exemplary system 200, in accordance with one embodiment. As an option, the system 200 may be implemented in the context of the end user computer 106 of FIG. 1. Of course, the system 200 may be implemented in any desired environment.

As shown, a system 200 is provided including at least one central processor 201 which is connected to a communication bus 202. The system 200 also includes main memory 204 [e.g. random access memory (RAM), etc.]. The system 200 also includes a graphics processor 206 and a display 208.

The system 200 may also include a secondary storage 210. The secondary storage 210 includes, for example, a hard disk drive and/or a removable storage drive, representing a floppy disk drive, a magnetic tape drive, a compact disk drive, etc. The removable storage drive reads from and/or writes to a removable storage unit in a well known manner.

Computer programs, or computer control logic algorithms, may be stored in the main memory 204 and/or the secondary storage 210. Such computer programs, when executed, enable the system 200 to perform various functions. Memory 204, storage 210 and/or any other storage are possible examples of computer-readable media.

Furthermore, a control system interface 212 is provided. Such control system interface 212 may be used to instruct a control system (not shown) associated with one or more particle entrained gas jets to implement the method(s) set forth below, for example, in accordance with any desired software and/or hard-coded instructions.

Figure 3:
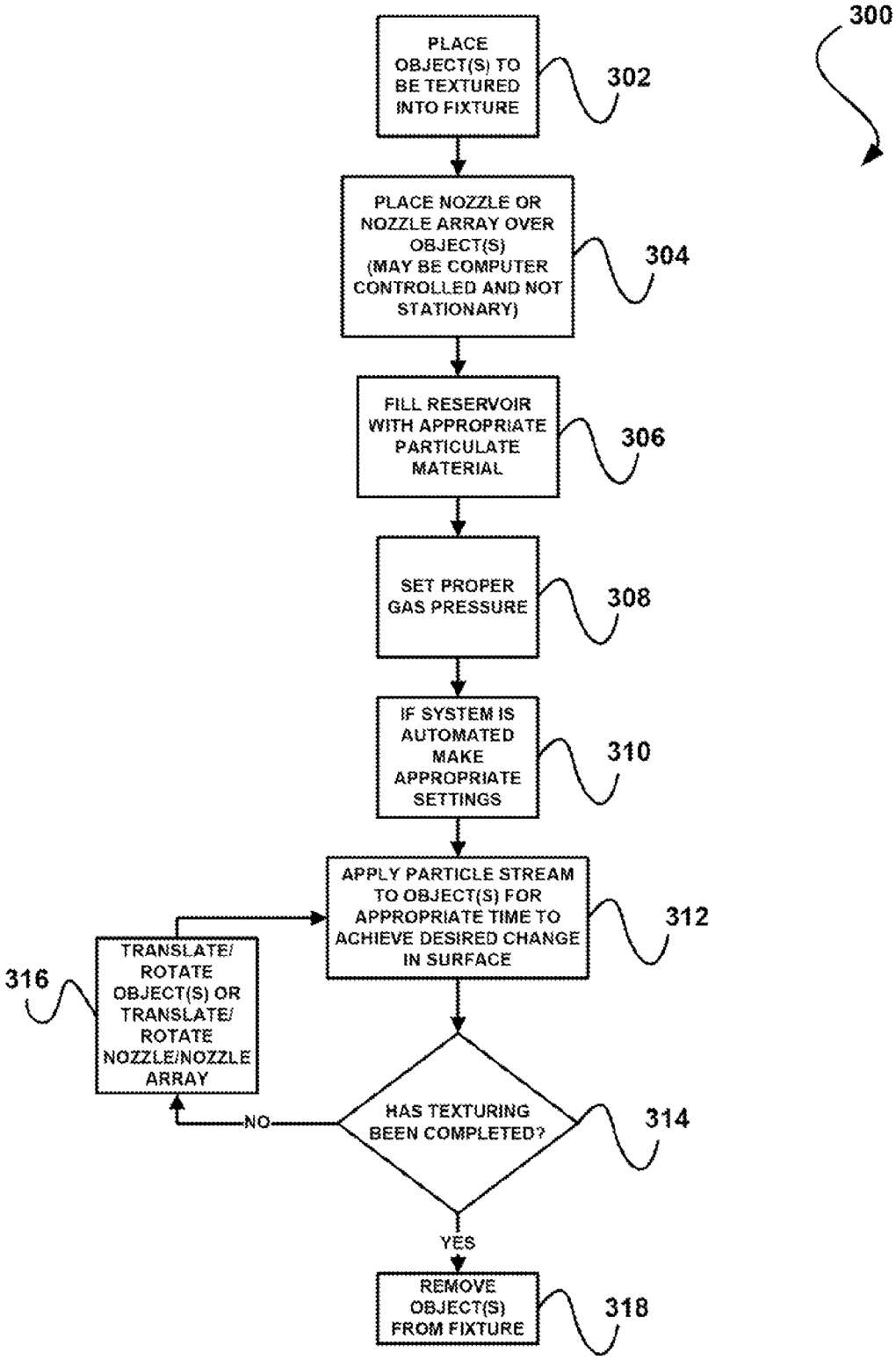
FIG. 3 illustrates a method for providing a form and/or surface structure to a component, in accordance with one embodiment.

FIG. 3 shows a method 300 for providing a form and/or surface structure to a component, in accordance with one embodiment. As an option, the method 300 may be implemented in the context of the details of FIGS. 1 and/or 2. Of course, however, the method 300 may be carried out in any desired environment. Further, the aforementioned definitions may equally apply to the description below.

In the context of the present description, the process of texturing refers to any technique that results in surface features being formed on an object. For example, in various embodiments, the texturing may include, but is not limited to creating depressions, slots, cuts, protuberances, and/or combinations thereof, and/or any other technique that meets the above definition.

Further, in the context of the present description, surface texture refers to surface features on an object. For example, in various embodiments, such surface texture may include holes, dimples, grooves, slots, cuts, other geometric shapes or combinations of these shapes, and/or any other surface texture that meets the above definition.

As shown in operation 302, an object to be textured is placed and secured in a fixture used for carrying out the method set forth in the present embodiment. Further, it may be desirable to stress relieve the object at this time, prior to texturing.

After securing the object to the fixture, a nozzle or nozzle array of an associated particle entrained gas jet, or a plurality of particle entrained gas jets, is placed over or next to the object at a predetermined distance, as shown in operation 304.

It should be noted that there may be one nozzle or an array of nozzles utilized in various embodiments. In addition, the array of nozzles may be composed of nozzles of different designs. For example, the inside diameter, length, and material(s) of the nozzles may vary.

Further, in operation 306, a reservoir of is filled with an appropriate particulate material. The selection of the appropriate particulate material (e.g. the size, shape, hardness, density, composition, etc.) may be dependent on the material of the object to be textured, in addition to the surface texture desired. Thus, the particulate material may include round particles, smooth particles, etc. For example, the particulate material may texture the surface of the object by creating macro features on the surface of the object using various particles, thus allowing various types of textures to be achieved.

Some examples of particulate materials that may be used include, but are not limited to aluminum oxide, garnet, silicon carbide, silicon oxide, crushed glass, glass beads, sodium bicarbonate, walnut shells, pumice, aluminum nitride, or combinations thereof. However, any other material with hard, brittle and dense qualities may be used. Further, the size of the particulate material may range from 10 microns to 300 microns or larger, for example. Of course, it should be noted that the present embodiment is not limited to any of the foregoing examples and/or ranges.

Once the appropriate particulate material is selected, a gas pressure of the gas used to project the particulate material is set to a value that will achieve the desired surface texture, as shown in operation 308. The gas used may be any gas such as air, argon, helium, nitrogen and/or any other gaseous element or compound. In one embodiment, the velocity at which particles of the particulate material is projected may be proportional to the gas pressure. Thus, higher gas pressure may allow the particulate material to be projected on the object at an increased rate, such that the texture may accordingly be created at an increased rate. In addition, higher gas pressure may increase the removal rate of material, such as hard brittle materials.

As shown in operation 310, if the nozzle/nozzle array placement and/or translation (e.g. scanning, traversing, rotating, any other movement, etc.) is automatically controlled; appropriate settings for the automated process are selected as desired. Similarly, if the object placement and/or translation is automatically controlled, appropriate settings for the automated process may be selected as desired. However, it should be noted that the control of the texturing process may be electronic or mechanical in nature. Thus, manual placement and/or translation of the object(s) to be textured may be employed. See operation 310. Likewise, manual placement and/or translation of the nozzle/nozzle array may similarly be used, as noted in operation 310.

In various embodiments, the translating configuration of operation 310 may be chosen based on whether the object to be textured should be translated in front of the stationary gas entrained jet, the gas entrained jet should be translated in front of the stationary object, or a combination thereof. Translate configuration parameters include, but are not limited to transit time and dwell time, which may be adjusted to create a variety of surface features. The features formed are generally depressions, protuberances, slots and combinations thereof.

It should be noted that the optimal translating configuration may be based on consideration of such things as the size, symmetry, material and shape of the component, as well as the size, shape, and number of features that are desired to be formed within the object surface, for example.

Further, as shown in operation 312, a high velocity particle entrained stream is applied to the component for an appropriate time to achieve a desired change in the surface. Such particle stream may be applied by one particle entrained gas jet, or a plurality of particle entrained gas jets simultaneously.

Furthermore, in operation 312, the particle stream may be applied by translating the object with respect to the stationary jet(s), or the jet(s) may be translated with respect to the stationary object. Additionally, the jet(s) may be translated in conjunction with translating the object, as discussed above. In such case, such translating may occur on the same or a different axis.

As mentioned above, the translating parameters are set in operation 310. In addition, the appropriate time to achieve the desired result is set in operation 310. In various embodiments, such appropriate time may be determined based on the object to be textured, the particulate material used, and the resultant texture desired.

The desired resultant texture may include holes, dimples, grooves, other geometric shapes or combinations of these shapes, for example. Further, any appropriate control system, device, or mechanism may be used to engage the gas flow and the particulate flow for the appropriate time to achieve the desired texture. See FIGS. 1 and/or 2, for example.

It should also be noted that, if desired, heating or cooling of the object may be accomplished prior to operation 312. Heating or cooling the object to be textured prior to the texturing operation may enhance the material removal rate of certain materials.

Heating the component may, in one embodiment, comprise pre-heating the object to a temperature that is less than a temperature at which the object begins to melt, flow, or undergo substantial decomposition, for example. Further, heating the object surface may include heating using a radiant heat lamp, inductive heater, and/or an infra-red type resistive heater, for example. Furthermore, cooling the object may include cooling below the embrittlement or glass transition temperature of the material. Such heating or cooling may be implemented using an automated process, and/or a manual process.

Just by way of example, a pulsed jet may be utilized. Thus, in one embodiment, the object may be translated, the jet may be pulsed, and the object may be translated again. In another embodiment, the jet may remain in a pulsing state during translation of the object, such that the object may be translated under the pulsing jet.

In operation 314, it is determined whether the desired texturing has been completed or whether the automated cycle has been completed, if appropriate. If the texturing has not been completed and further texturing is desired (e.g. at a different location on the object, etc.), the object may be translated and/or replaced with respect to the nozzle/nozzle array, as shown in operation 316. It should be noted that it may be desirable to stress relieve the object after forming the texture in operation 312 before any further operations.

In another embodiment, the nozzle/nozzle array may be translated and/or replaced with respect to the object. Further, the nozzle/nozzle array may be translated and/or replaced with respect to the object, in conjunction with translating and/or replacing the object with respect to the nozzle/nozzle array. As an option, the object may be textured using a series of texturing steps using various nozzle/nozzle array configurations.

In addition, any or all of these translations and/or replacements may be accomplished using either automated equipment, manually, or both. For example, in one embodiment, the nozzle/nozzle array may be translated automatically, whereas the object is translated manually, or vise versa.

Furthermore, in operation 316, the particle entrained gas jet may be used to form features on a second surface of the object to compensate for any possible distortion caused by forming features on a first surface. Such compensation, if desired, may be elected in operation 310, for example.

In order to achieve the desired result, the surface and features of the object may be roughened using any method including bead blasting or chemical roughening. Further, the object may be stress relieved after bead blasting the object, as desired. In addition, the object may be cleaned after the bead blasting using chemicals or any other cleaning procedure. Once the desired texture has been achieved in all desired areas, the object is removed from the fixture, as shown in operation 318.

More illustrative information will now be set forth regarding various optional architectures and uses in which the foregoing method may or may not be implemented, per the desires of the user. It should be strongly noted that the following information is set forth for illustrative purposes and should not be construed as limiting in any manner. Any of the following features may be optionally incorporated with or without the exclusion of other features described.

In one embodiment, the method 300 may be utilized for providing a unique form and surface structure to a component, such as a semiconductor process chamber component. For example, the semiconductor process chamber components may include a chamber shield and related assembly, a target, a shadow ring, a contact ring, a deposition ring, a substrate support or other component disposable within a semiconductor processing chamber. Furthermore, such semiconductor process chamber components may undergo the texturing process individually, or as a group of components.

In another embodiment, the method 300 may be utilized for providing a unique form and surface structure to a medical device. The medical device may include orthopedic implants, and/or any other devices whose performance is enhanced by texturing, for example.

In yet another embodiment, the method 300 may be utilized for providing a unique form and surface structure to an aerospace device. The aerospace component may include engine components and/or any other devices whose performance is enhanced by texture, for example.

In even another embodiment, the method 300 may be utilized for providing a unique form and surface structure to an optical component. For example, the texturing process may be applied to light baffles and light traps, such as beam dumps, in order to control scattering, etc.

Further, in other embodiments, the method 300 may be utilized for quickly forming a plurality of features in the surface of materials such as ceramic, glass, stone, metals, and/or composites.

Figure 4:
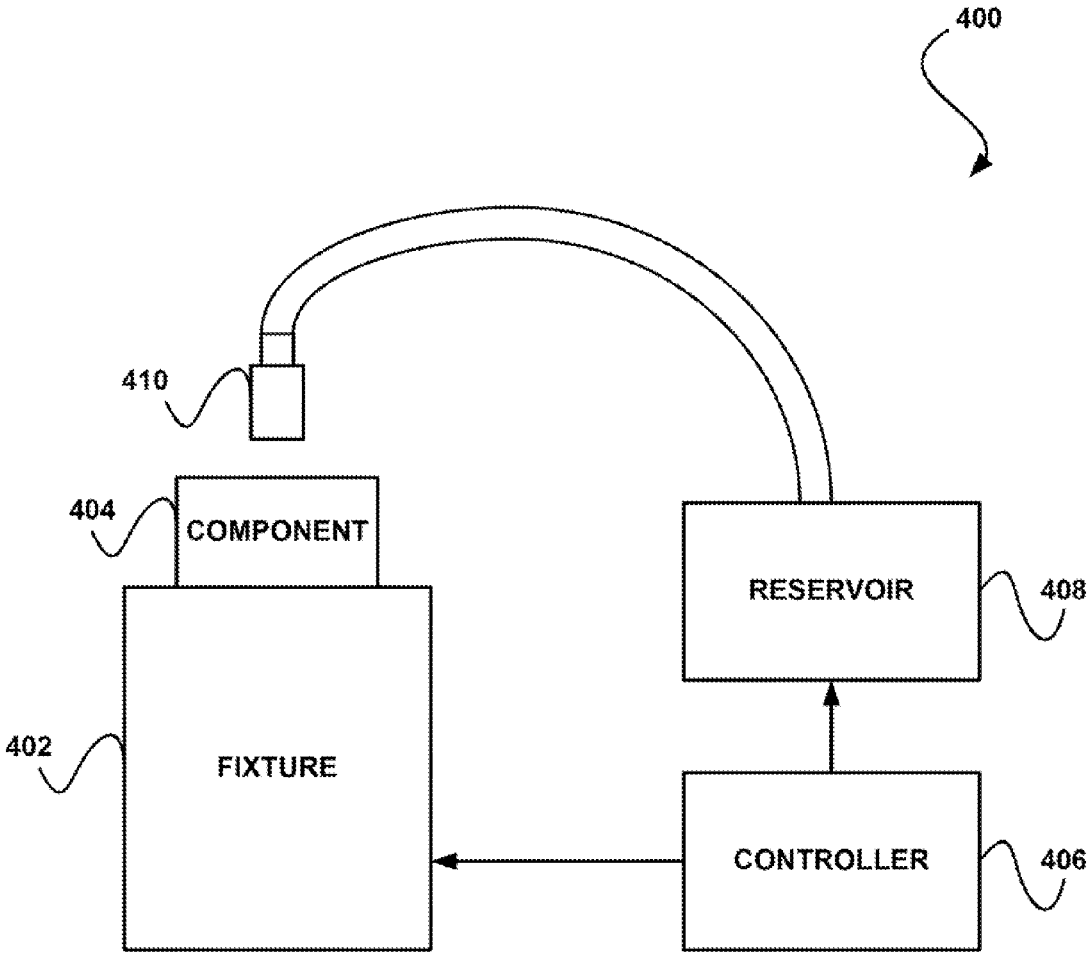
FIG. 4 illustrates a system for providing a form and/or surface structure to a component, in accordance with another embodiment.

FIG. 4 illustrates a system 400 for providing a form and/or surface structure to a component, in accordance with another embodiment. As an option, the system 400 may be implemented in the context of the architecture and environment of FIGS. 1-3. Of course, however, the system 400 may be implemented in any desired environment. It should also be noted that the aforementioned definitions may apply during the present description.

As shown, a component 404 to be textured is placed and secured in a fixture 402. With respect to the present embodiment, the fixture 402 may include the fixture described above with respect to FIG. 3. Thus, the fixture 404 may optionally be used for carrying out the method 300 set forth in FIG. 3.

In addition, a reservoir 408 is filled with particulate material of approximately uniform size. The particulate material may include material capable of being utilized to texture the component 404 as desired. Thus, the particulate material included in the reservoir 408 may be dependent on the material of the component 404 to be textured, in addition to the surface texture desired.

Further, a nozzle 410 is coupled to the reservoir 408. The nozzle 410 may be of an associated particle entrained gas jet, in one embodiment. As shown, the nozzle 410 is positioned over the component 404 at a predetermined distance. In this way, an opening of the nozzle 410 may be facing toward the component 404, such that the nozzle 410 may be utilized for projecting the particulate material in the reservoir 408 to a surface of the component 404.

In one embodiment, the particle entrained gas jet associated with the nozzle 410 may project the particulate material in the reservoir 408 to the surface of the component 404. For example, a gas pressure of gas associated with the particle entrained gas jet may be used to project the particulate material onto the component 404, such that a desired surface texture of the component 404 may be achieved.

Still yet, a controller 406 is coupled between the fixture 402 and the reservoir 408. The controller 406 may be utilized for controlling the position and/or translation of the nozzle 410, in one embodiment. In another embodiment, the controller 406 may control the position of the fixture 402, such that the fixture 402 may be controlled to move, rotate, etc. the attached component 404. This may be accomplished by any desired motorized mechanical arrangement. For example, the fixture 402 may be coupled to a movable part (e.g. a rotator, X/Y/Z-axis translator, etc.) that may be moved by a motorized mechanism, under the control of the controller 406. In this way, the nozzle 410 and/or the fixture 402 may optionally be automatically controlled via the controller 406 for achieving the desired placement of the texture on the component 404.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An apparatus, comprising:

at least one jet; and a controller in communication with the at least one jet, the controller operable to translate a surface of a component relative to the at least one jet for a period of time to form a plurality of features thereon;

wherein the features include surface texture, and the surface texture is formed utilizing at least a partial removal of material;

wherein a pressure of gas used to project the material onto the surface of the component is set to a value that will achieve the surface texture and a velocity at which particles of the material are projected is proportional to the pressure, such that higher pressure allows the material to be projected on the surface of the component at an increased rate to create the surface texture at an increased rate and to increase a removal rate of the material projected on the surface of the component.

2. The apparatus as set forth in claim 1, wherein the jet includes a particle entrained gas jet.

3. The apparatus as set forth in claim 1, wherein a plurality of jets is included.

4. The apparatus as set forth in claim 1, wherein the surface of the component is translated relative to the at least one jet, by translating the component.

5. The apparatus as set forth in claim 1, wherein the surface of the component is translated relative to the at least one jet, by translating the at least jet.

6. The apparatus as set forth in claim 1, wherein the at least one jet is operable to project the material on the component to form the plurality of features thereon.

7. The apparatus as set forth in claim 6, wherein the material includes particulate material.

8. The apparatus as set forth in claim 1, wherein the translation is manual.

9. The apparatus as set forth in claim 1, wherein the translation is automatic.

10. The apparatus as set forth in claim 1, wherein the component is heated prior to the translation.

11. The apparatus as set forth in claim 1, wherein the component includes a semiconductor processing chamber component.

12. The apparatus as set forth in claim 1, wherein the component includes a medical device component.

13. The apparatus as set forth in claim 1, wherein the component includes an aerospace device component.

14. The apparatus as set forth in claim 1, wherein the component includes an optical device component.

15. The apparatus as set forth in claim 1, wherein the component is securable by a fixture.

16. The computer program product as set forth in claim 1, wherein the surface texture formed utilizing the at least a partial removal of the material includes at least one of holes, dimples, grooves, depressions, protuberances, and slots.

17. A method, comprising:

translating a surface of a component relative to at least one jet for a period of time to form a plurality of features thereon;

wherein the features include surface texture, and the surface texture is formed utilizing at least a partial removal of material;

wherein a pressure of gas used to project the material onto the surface of the component is set to a value that will achieve the surface texture and a velocity at which particles of the material are projected is proportional to the pressure, such that higher pressure allows the material to be projected on the surface of the component at an increased rate to create the surface texture at an increased rate and to increase a removal rate of the material projected on the surface of the component.

18. The method as set forth in claim 17, wherein the jet includes a particle entrained gas jet.

19. The method as set forth in claim 17, wherein the surface of the component is translated relative to a plurality of jets.

20. The method as set forth in claim 17, wherein the surface of the component is translated relative to the at least one jet, by translating the component.

21. The method as set forth in claim 17, wherein the surface of the component is translated relative to the at least one jet, by translating the at least jet.

22. The method as set forth in claim 17, wherein the at least one jet is operable to project the material on the component to form the plurality of features thereon.

23. The method as set forth in claim 22, wherein the material includes particulate material.

24. The method as set forth in claim 17, wherein the translation is manual.

25. The method as set forth in claim 17, wherein the translation is automatic.

26. The method as set forth in claim 17, wherein the component is heated prior to the translation.

27. The method as set forth in claim 17, wherein the component includes a semiconductor processing chamber component.

28. The method as set forth in claim 17, wherein the component includes a medical device component.

29. The method as set forth in claim 17, wherein the component includes an aerospace device component.

30. The method as set forth in claim 17, wherein the component includes an optical device component.

31. The method as set forth in claim 17, wherein the component is securable by a fixture.

32. A computer program product embodied on a computer readable medium, comprising:

computer code for controlling an apparatus to translate a surface of a component relative to at least one jet for a period of time to form a plurality of features thereon;

wherein the features include surface texture, and the surface texture is formed utilizing at least a partial removal of material;

wherein a pressure of gas used to project the material onto the surface of the component is set to a value that will achieve the surface texture and a velocity at which particles of the material are projected is proportional to the pressure, such that higher pressure allows the material to be projected on the surface of the component at an increased rate to create the surface texture at an increased rate and to increase a removal rate of the material projected on the surface of the component.

33. The computer program product as set forth in claim 32, wherein the jet includes a particle entrained gas jet.

34. The computer program product as set forth in claim 32, wherein the surface of the component is translated relative to a plurality of jets.

35. The computer program product as set forth in claim 32, wherein the surface of the component is translated relative to the at least one jet, by translating the component.

36. The computer program product as set forth in claim 32, wherein the surface of the component is translated relative to the at least one jet, by translating the at least jet.

37. The computer program product as set forth in claim 32, wherein the at least one jet is operable to project the material on the component to form the plurality of features thereon.

38. The computer program product as set forth in claim 37, wherein the material includes particulate material.

39. The computer program product as set forth in claim 32, wherein the translation is manual.

40. The computer program product as set forth in claim 32, wherein translation is automatic.

41. The computer program product as set forth in claim 32, wherein the component is heated prior to the translation.

42. The computer program product as set forth in claim 32, wherein the component includes a semiconductor processing chamber component.

43. The computer program product as set forth in claim 32, wherein the component includes a medical device component.

44. The computer program product as set forth in claim 32, wherein the component includes an aerospace device component.

45. The computer program product as set forth in claim 32, wherein the component includes an optical device component.

46. The computer program product as set forth in claim 32, wherein the component is securable by a fixture.

* * * * *